US006976670B1

(12) United States Patent
Woolley et al.

(10) Patent No.: US 6,976,670 B1
(45) Date of Patent: Dec. 20, 2005

(54) HYDRAULIC PULLER APPARATUS

(76) Inventors: Brent Alan Woolley, 11,114 Sela La., Houston, TX (US) 77072; Stephen Garrett Starr, II, 15631 Boulder Oaks, Houston, TX (US) 77084

( * ) Notice: Subject to any disclaimer, the term of this patent is extended or adjusted under 35 U.S.C. 154(b) by 0 days.

(21) Appl. No.: 11/020,056

(22) Filed: Dec. 23, 2004

(51) Int. Cl.[7] ..... E21B 19/00
(52) U.S. Cl. ..... 254/30; 254/133 R
(58) Field of Search ..... 254/30, 131, 133; 166/379, 377

(56) References Cited

U.S. PATENT DOCUMENTS

| | | | | |
|---|---|---|---|---|
| 3,317,185 | A | 5/1967 | Burk et al. | |
| 3,647,185 | A * | 3/1972 | Phibbs | 254/30 |
| 5,794,918 | A | 8/1998 | Price | |
| 6,234,253 | B1 * | 5/2001 | Dallas | 166/377 |
| 6,302,380 | B1 | 10/2001 | Ultimo et al. | |
| 6,398,188 | B1 | 6/2002 | Salman | |
| 6,527,250 | B1 | 3/2003 | Tyson | |
| 6,598,856 | B1 | 7/2003 | Puff et al. | |
| 6,655,875 | B1 | 12/2003 | Pignato | |
| 6,712,147 | B2 * | 3/2004 | Dallas | 166/379 |
| 2002/0063245 | A1 * | 5/2002 | Salman | 254/30 |

* cited by examiner

*Primary Examiner*—Lee D. Wilson
(74) *Attorney, Agent, or Firm*—Kenneth A. Roddy

(57) ABSTRACT

A hydraulic puller apparatus for extracting objects from the ground, including objects anchored in a concrete slug, includes a pair of hydraulic jacks, each having a ram with an elongate lift arm pivotally connected at an upper end thereto; and a puller head having a pair of jaw support platforms disposed on opposite sides of a generally U-shaped opening. A pair of jaws each mounted on a respective jaw support platform are moved by respective drive screws to grip opposite sides of the object. The puller head is positioned with its opening straddling a lower end of the object, the jaws are engaged on opposite sides of the object, the jacks are placed on opposite sides of the object, and the lift arms are engaged in opposed ends of the puller head. Then the jacking mechanisms of the jacks are actuated, preferably simultaneously, to extend the rams and extract the object.

20 Claims, 6 Drawing Sheets

HYDRAULIC PULLER APPARATUS

BACKGROUND OF THE INVENTION

1. Field of the Invention

This invention relates generally to post and tree pullers and, more particularly, to a hydraulic puller apparatus for extracting fence posts, small trees, tent stakes, grounding rods, mailbox posts, sign posts, and the like, including such objects that may be anchored in a concrete slug.

2. Background Art

Devices for removing fence posts, poles, tent stakes, trees, ground rods, signposts, etc. are well known in the art. Typically, fence posts, poles, tent stakes, trees, ground rods, signposts, etc., are either hammered into the ground or set in concrete thus making removal difficult and time-consuming. Some posts will be found to have broken off near ground level due to rot, high wind, fallen trees, auto mishaps or some other cause. This presents a special removal problem. Another problem occurs when a post being removed slips out of its concrete slug while it is still in the ground. Various removal devices and methods have been implemented to solve these problems.

Most prior art removal devices use a chain wrapped around the object to be removed, together with a lever and fulcrum, complex hydraulic systems, come-alongs, winches, etc. Shovels, sledgehammers, and pry bars, as well as backhoes, tractors, and small skid steer tractors are also often used to remove these types of objects.

Although some of these devices have plenty of power, they are hardly practical to use in a residential setting. Not only would the noise and torn up landscape be objectionable, but they simply would not pass through the average walk-gate opening. Most people would prefer not to have a backhoe in the flowerbed. Thus, there exists a need for a simple, quiet, powerful, portable device that will quickly pull an object out of the ground with minimal effort.

There are several patents that disclose jack-type devices of various constructions for extracting fence posts and the like from the ground.

Burke et al, U.S. Pat. No. 3,317,185 discloses an apparatus for pulling stakes, posts and the like out of the ground. The apparatus has two elongated hydraulic cylinders members mounted in parallel relation and connected to each other on opposites sides of the object to be pulled. The cylinders have a ball and socket base that rests on the ground. A pair of opposed facing clamps connected to levers grip the object and have a free end connected to draw cables that pass over pulleys connected to the piston rods of the cylinders.

Price, U.S. Pat. No. 5,794,918 discloses an apparatus and method for pulling fence posts having a fulcrum stand with an action lever hingedly connected to one end and a receiving box for encompassing the object to be moved connected to the action lever. An action handle is attached to the receiving box and the fulcrum stand, and a moveable gripping pawl having an engagement edge and a non-engagement edge is connected to the action handle for engaging the object to be pulled as the action handle is raised. The fulcrum stand and the action handle are on opposite sides of the post to prevent bending of the posts as they are pulled.

Ultimo, Sr., et al, U.S. Pat. No. 6,302,380 discloses a portable injection-casing extractor tool that facilitates soil stabilization applications that utilize compaction grouting. The casing extraction tool has dual hydraulic cylinders that provide a lifting force capable of pulling sections of grout injection casing out of the ground at an operator-controlled rate. The dual cylinders are supported on a heavy-duty base plate and chassis and are powered by a remote hydraulic power unit or "mule". The base plate and chuck have aligned, open-face slots for positioning of the tool on installed casings and to utilize the casings for lateral support. The cylinders have an attached toothed progressive chuck mechanism that engage the injection casing at the beginning of a lifting stage and release it at the end of a lifting stage. The teeth of the progressive chuck are maintained generally flush to the casing wall during gripping and extraction steps to avoid gouging, denting and crushing movements that would damage the casings.

Salman, U.S. Pat. No. 6,398,188 discloses a post puller having an H-shaped base including a pair of parallel legs and a crossbeam normal to the legs, the crossbeam being offset from the midpoint of the legs and defining a shallow channel and a deep channel. A pair of rectangular blocks attached to the legs and crossbeam in the deep channel provides platforms on which a pair of single action hydraulic cylinders are mounted, and define a recess that straddles the post to be pulled. A cross member is pivotally mounted to each cylinder rod. A chain is suspended from the midpoint of the cross member. The chain may be wrapped directly around the post, or a post gripping structure may be attached to the free end of the chain. A pair of wheels may be mounted to the base for portability.

Pignato, U.S. Pat. No. 6,655,875 discloses a pier adjusting mechanism and method for facilitating the adjusting and leveling of a pier platform relative to a pier structure, the pier structure including at least a first post. The method includes the step of providing a platform height adjustment apparatus, the platform height adjustment apparatus including a platform support member and a height positioning mechanism. The platform height adjustment apparatus is slidably mounted on the first post. The post position of the platform height adjustment apparatus is fixed relative to the first post, the post position being situated above and proximate the pier platform. The platform support member is moved into a platform supporting position relative to the platform and the height positioning mechanism is actuated to lower or lift the pier platform.

Tyson, U.S. Pat. No. 6,527,250 discloses a device for pulling a planted post from the ground that includes a movably disposable base which is capable of disposal at least partially circumferentially about the planted post, a diametrically adjustable chain and hook gripping member connected to the base for securely gripping about the post, and a jack connected to the gripping member for mechanically displacing the gripping member and in turn the fence post from the ground.

Puff et al, U.S. Pat. No. 6,598,856 discloses a portable hydraulic stake puller that includes a hydraulic cylinder which extends to raise a jaw assembly. The jaw assembly pivots, while being raised, to grab and trap the stake. A grab hook may alternatively extract similar items not readily removable with the jaw assembly. The jaw or chain tension is controllably released when the control lever is released at any height of the stroke. Squeezing the control lever can again attain grip easily. The gripping action of the jaw is attained by at least friction against the jaw. When the control lever is released, the entire lift assembly returns to the neutral position under a spring tension. The hydraulic stake puller is mounted on wheels and controlled via handles allowing easy maneuvering.

The present invention is distinguished over the prior art in general, and these patents in particular by a hydraulic puller apparatus for extracting objects such as posts, small trees, stakes, rods, and the like, from the ground, including such objects that may be anchored in a concrete slug. The apparatus includes a pair of hydraulic jack members, each having an extensible and retractable ram member with an elongate lift arm pivotally connected at an upper end thereto and a outwardly extending horizontal tongue member at a lower end thereof. A puller head assembly is removably supported at opposed ends on the horizontal tongue members and has a pair of generally rectangular jaw support platforms disposed in parallel laterally spaced relation defining a central generally U-shaped opening therebetween which is open on one side and sized to straddle the width of the object to be extracted. A jaw member is slidably mounted on each jaw support platform in opposed facing relation for movement between a retracted position away from the U-shaped opening and an extended gripping position engaged on the object to be extracted, and each has a generally rectangular transverse grip portion configured to grip opposite sides of the object to be extracted. A drive screw member is threadedly engaged on each jaw support platform in opposed facing relation and has an inner facing end engaged with the respective jaw member for moving it between said retracted and extended positions upon rotation thereof, and each has an outer facing end configured to receive rotating means for rotating it.

To extract the object, the puller head is positioned with its U-shaped opening straddling a lower end of the object, the drive screws are rotated to move the jaws to their extended gripping position firmly engaged on opposite sides of the object, the jack members are placed on opposite sides of the object, and the lift arm tongue members are engaged in opposed ends of the jaw support platforms. The jacking mechanisms of the jack members are then actuated, preferably simultaneously, to extend the ram members to a height sufficient to extract the object from the ground.

SUMMARY OF THE INVENTION

It is therefore an object of the present invention to provide a hydraulic puller apparatus for extracting square or round fence posts, small trees, tent stakes, grounding rods, mailbox posts, sign posts, and the like, of various size including such objects that may be anchored in concrete.

It is another object of this invention to provide a hydraulic puller apparatus for extracting objects anchored in the ground, including such objects that may be anchored in concrete, that can be easily and quickly set up and grip the object and operated by a single person to extract the object in a matter of minutes using a simple hand tool.

Another object of this invention is to provide a hydraulic puller apparatus that does not require a large area for extracting objects anchored in the ground including objects that may be located flush to a house or garage wall and to easy replace just one post in a fence.

Another object of this invention is to provide a hydraulic puller apparatus for extracting objects anchored in the ground, including such objects that may be anchored in concrete, that does not require digging out the object or its concrete slug, does not leave a large hole after extraction, does not disturb the surrounding soil or cause trauma to the surrounding landscape or foliage.

A further object of this invention is to provide a hydraulic puller apparatus for extracting objects anchored in the ground, including such objects that may be anchored in concrete, that has a wheel attachment to allow the extracted object and its concrete slug to be easily rolled away, and allow the puller apparatus to be easily transported from one object to the next.

A still further object of this invention is to provide a hydraulic puller apparatus that is simple in construction, inexpensive to manufacture, and rugged and reliable in operation.

Other objects of the invention will become apparent from time to time throughout the specification and claims as hereinafter related.

The above noted objects and other objects of the invention are accomplished by the present hydraulic puller apparatus for extracting objects such as posts, small trees, stakes, rods, and the like, from the ground, including such objects that may be anchored in a concrete slug. The apparatus includes a pair of hydraulic jack members, each having an extensible and retractable ram member with an elongate lift arm pivotally connected at an upper end thereto and a outwardly extending horizontal tongue member at a lower end thereof. A puller head assembly is removably supported at opposed ends on the horizontal tongue members and has a pair of generally rectangular jaw support platforms disposed in parallel laterally spaced relation defining a central generally U-shaped opening therebetween which is open on one side and sized to straddle the width of the object to be extracted. A jaw member is slidably mounted on each jaw support platform in opposed facing relation for movement between a retracted position away from the U-shaped opening and an extended gripping position engaged on the object to be extracted, and each has a generally rectangular transverse grip portion configured to grip opposite sides of the object to be extracted. A drive screw member is threadedly engaged on each jaw support platform in opposed facing relation and has an inner facing end engaged with the respective jaw member for moving it between said retracted and extended positions upon rotation thereof, and each has an outer facing end configured to receive rotating means for rotating it.

To extract the object, the puller head is positioned with its U-shaped opening straddling a lower end of the object, the drive screws are rotated to move the jaws to their extended gripping position firmly engaged on opposite sides of the object, the jack members are placed on opposite sides of the object, and the lift arm tongue members are engaged in opposed ends of the jaw support platforms. The jacking mechanisms of the jack members are then actuated, preferably simultaneously, to extend the ram members to a height sufficient to extract the object from the ground.

DESCRIPTION OF THE PREFERRED EMBODIMENTS

Figure 1:
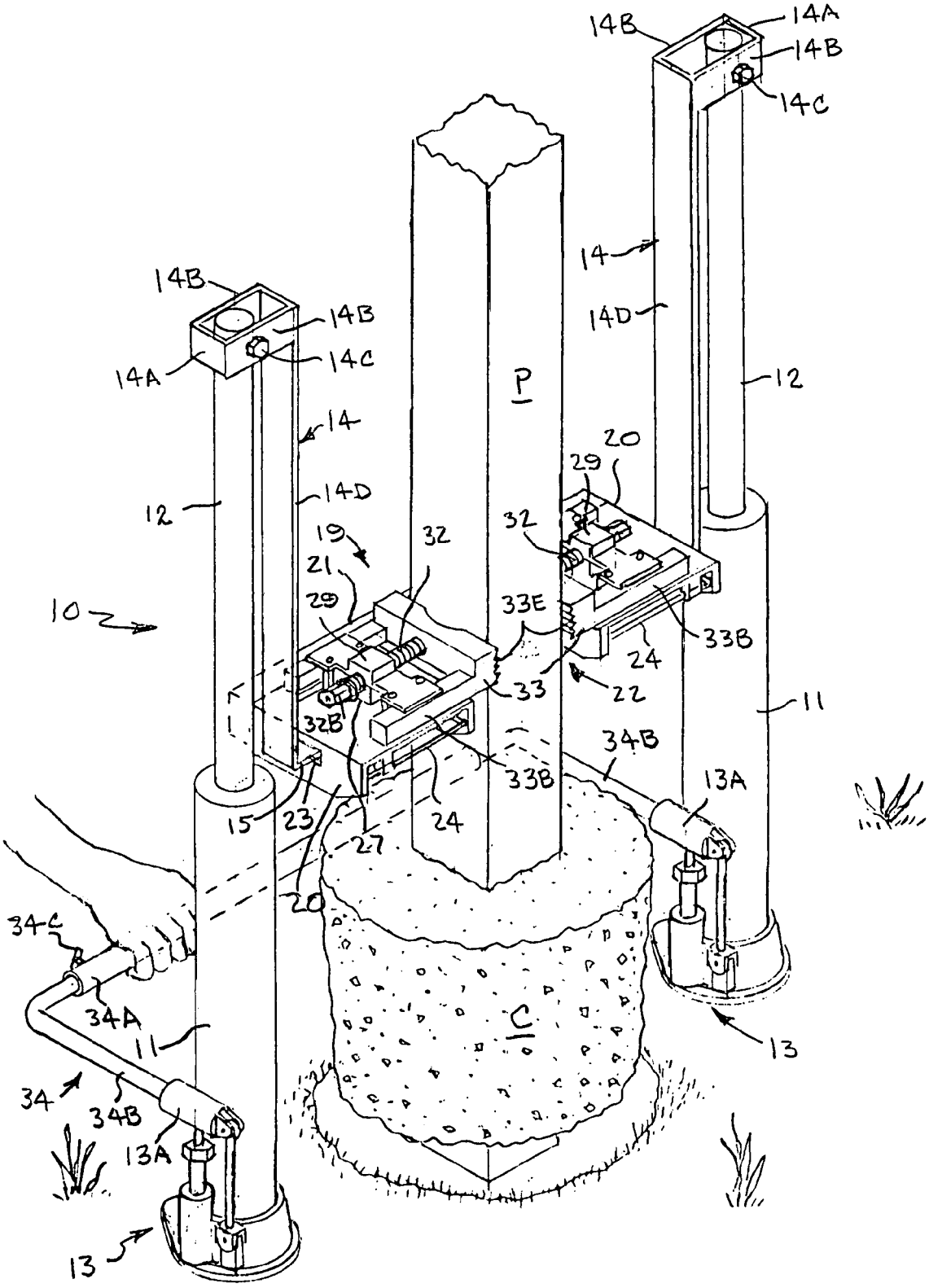
FIG. 1 is a pictorial illustration of the hydraulic post and tree puller apparatus, in accordance with the present invention, shown in a position extracting a fence post and its concrete slug out of the ground, with the hand of the operator shown somewhat schematically operating the pump handle to operate both hydraulic jacks simultaneously.
Figure 2:
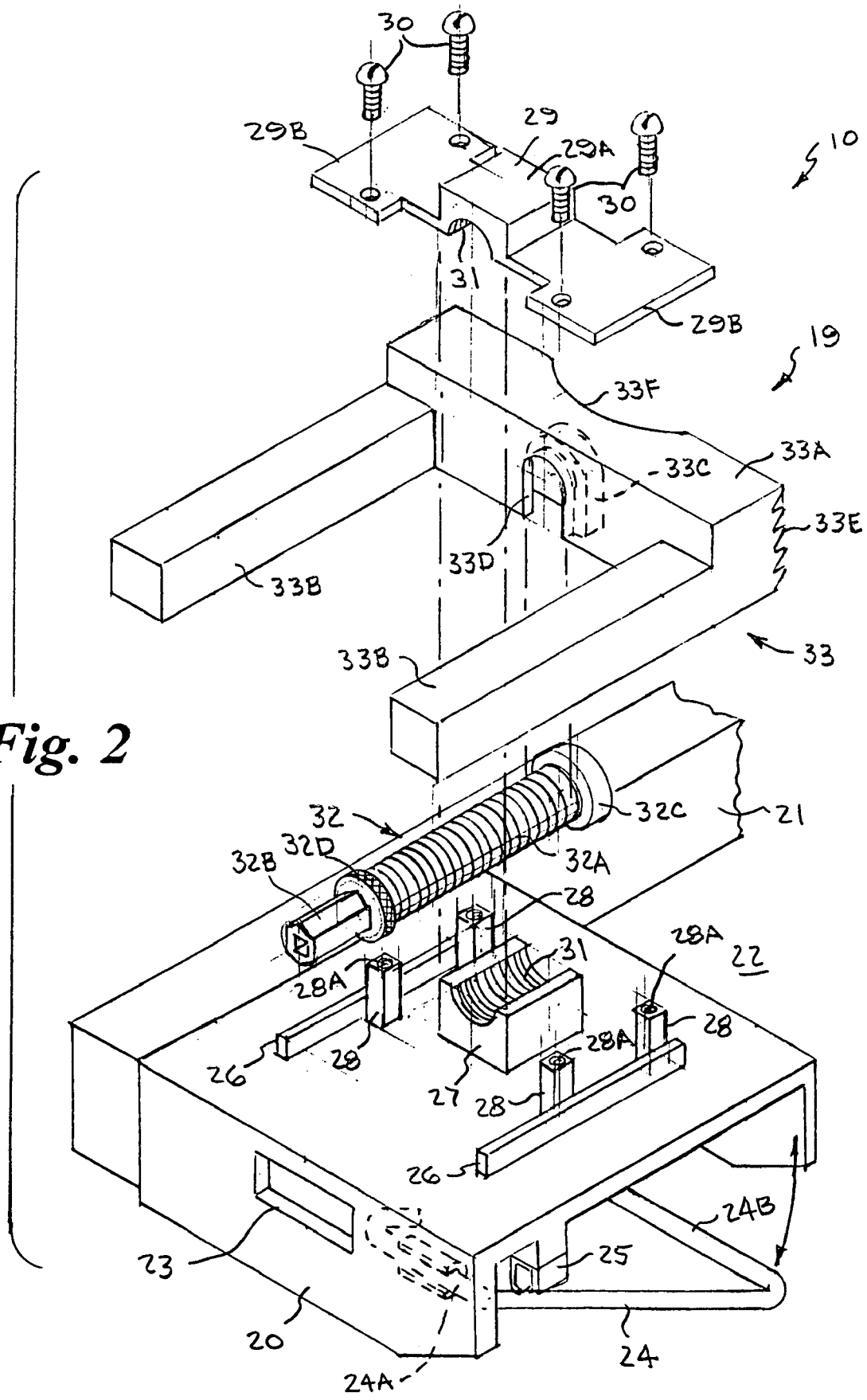
FIG. 2 is an exploded isometric view of one side of the puller head of the post puller apparatus in an unassembled condition.
Figure 3:
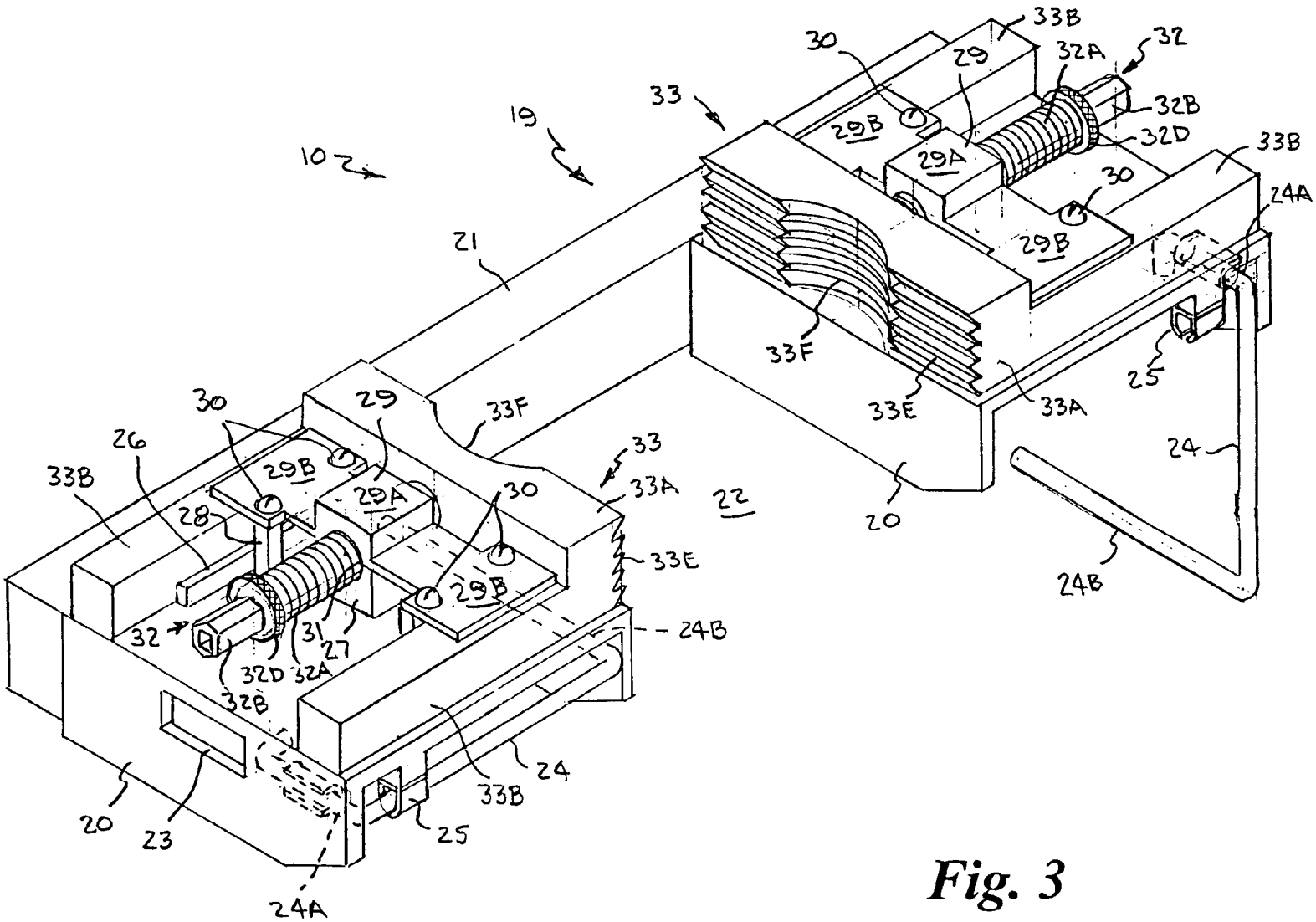
FIG. 3 is an isometric view of the puller head of the post puller apparatus in an assembled condition.

Referring to the drawings by numerals of reference, there is shown in FIGS. 1, 2 and 3, a preferred post puller apparatus 10. The post puller apparatus 10 includes a pair of modified hydraulic jack members 11, each having an extensible and retractable piston rod or ram member 12 that is raised and lowered by a pump rod and cylinder assembly 13 at its base. A lift arm 14 is pivotally connected at the top end of each ram member 12. Each lift arm 14 is a generally L-shaped member having a yoke or rectangular frame portion 14A at its upper with a pair of laterally opposed side members 14B that straddle the upper end of the respective ram member 12 and are pivotally connected thereto by a transverse bolt and nut 14C. An elongate vertical leg 14D adjoined at its upper end to one end of the frame portion 14A extends downwardly therefrom and terminates in an outwardly extending shorter horizontal leg or tongue 15.

The rectangular frame portion 14A of each lift arm 14 is sized such that the elongate vertical leg 14D extends downwardly therefrom a distance laterally outwardly from the circumference of the lower cylindrical portion of the respective hydraulic jack member 11, and the horizontal tongue portions 15 of the lift arms are capable of being positioned in laterally opposed facing relation. This arrangement allows the lower end of the lift arms 14 to pivot to a short distance toward and away from the object to be lifted, and facilitates alignment when inserting the horizontal tongue 15 into a receiving slot on the jaw support platform of the puller head, as described hereinafter. This arrangement also allows for accommodating some uneven ground conditions typically encountered, and allows the jacks to tilt to some degree in the direction of the object to be lifted.

Figure 4:
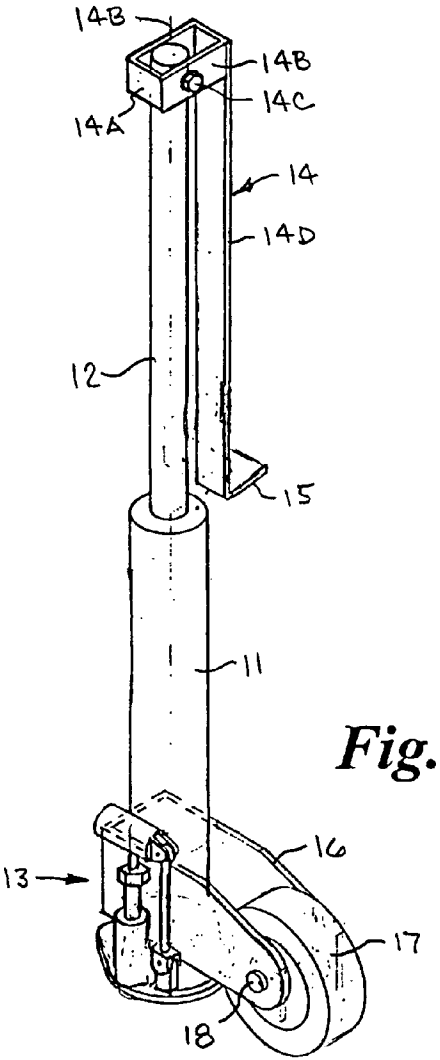
FIG. 4 is an isometric view of a jack member modified to receive a wheel for portability.

Optionally, as shown in FIG. 4, each jack member 11 may be further modified to receive a wheel for portability. This is accomplished by securing a U-shaped bracket 16 to the lower portion of the jack 11 and rotatably mounting a wheel 17 therein by a pin 18. The pin 18 may be removable so that the wheel 17 can be selectively installed or removed as needed for clearance in confined spaces or other purposes. A preferred wheel 17 is approximately 6" to 10" inches in diameter. When installed, the wheel 17 also serves to increase the base footprint area and thereby reduce the likelihood of the jacks 11 sinking into the ground when pulling a post.

A generally rectangular puller head assembly 19 is removably supported at opposed ends on the horizontal tongue portions 15 of the lift arms 14. The puller head 19 has a pair of generally rectangular jaw support platforms 20 secured along one side to an elongate horizontal beam 21 in parallel laterally spaced relation defining a central generally U-shaped opening 22 therebetween which is open on one side and sized to straddle the width of the object to be lifted. The outer ends of the jaw support platforms 20 are provided with a generally rectangular opening or slot 23 in which the horizontal tongue 15 of the respective lift arm 14 is received. The vertical legs 14D of the lift arms 14 are of a sufficient length such that horizontal tongue 15 may be engaged in the rectangular opening or slot 23 in the ends of the jaw support platforms 20 when the puller head 21 is at, or just above, ground level to increase the stability of the post, concrete, puller head and jacks when the jacks have reached their maximum height. The length of the vertical legs 14D of the lift arms 14 also allow gripping and lifting of the object to initiate close to ground level, and thereby provide more stability than gripping and lifting from a greater distance above the ground.

Each jaw support platform 20 may be provided with a support stand 24, which is pivotally connected at a first end 24A adjacent to an outer end of a respective jaw support platform, and has a second ground engaging end 24B. The support stand 24 may be pivoted between a generally horizontal stored position and a generally vertical ground engaging support position to support the puller head 19 a short distance above ground level. Each support stand 24 may be releasably clipped in a generally horizontal stored position by a spring clip 25 secured to the respective jaw support platform 20.

Each jaw support platform 20 has a pair of parallel spaced upstanding longitudinal guide rails 26 on its top surface spaced inwardly from each longitudinal side, respectively. A generally rectangular drive block 27 is disposed centrally between the guide rails 26 on the top surface of each jaw support platform 20 a distance outwardly from the generally U-shaped opening 22. A pair of parallel spaced vertical mounting posts 28 are disposed inwardly adjacent to each of the longitudinal guide rails 26 and extend a short distance thereabove. The mounting posts 28 are substantially the same height as the height of the drive block 27 and have internally threaded bores 28A at their top ends.

As best seen in FIGS. 2 and 3, a retainer plate 29 having a central rectangular portion 29A and a pair of T-shaped portions 29B extending from opposed sides thereof is mounted on the top of the drive block 27 and mounting posts 28 by threaded fasteners 30 passing through the T-shaped portions and threadedly engaged in the threaded bores 28A of the mounting posts. The central rectangular portion 29A is substantially the same length and width as the drive block 27.

In a preferred embodiment, the drive block 27 and the rectangular portion 29A of the retainer plate 29 are initially formed of a single rectangular member which is drilled and tapped with an internal Acme thread 31, or other suitable thread, and separated by a horizontal cut passing through the center of the thread, so as to form a split-nut configuration when assembled together.

A drive screw 32 having a shank 32A with external threads is installed in the threaded portion 31 of the drive block 27 and then the rectangular portion 29A of the retainer plate 29 is secured thereover such that the shank of the drive screw is threadedly and rotatably engaged therebetween when assembled together. The outer end of the drive screw 32 has a hexagonal portion 32B and its opposed end facing the U-shaped opening 22 is provided with an enlarged diameter radial flange 32C. A second larger diameter radial flange 32D is disposed between the hexagonal portion 32B and the threaded portion of the shank 32A to serve as a stop surface and may be knurled to allow manual rotation and/or adjustment.

A jaw member 33 is slidably mounted on each jaw support platform 20 of the puller head assembly 19 to be moved relative thereto by the respective drive screw 32. Each jaw member 33 has a generally rectangular transverse head portion 33A with a pair of elongate parallel spaced slide bars 33B extending rearwardly therefrom which are slidably received on the top surface of the respective jaw support platform 20 inwardly adjacent to the upstanding longitudinal guide rails 26 at each side of the jaw support platform. Each jaw member 33 has an interior inverted larger U-shaped recess 33C extending upward from its bottom surface to receive the radial flange 32C of the respective drive screw 32 and a smaller diameter inverted U-shaped slot 33D in communication therewith extending through its back surface to receive the shank 32A of the drive screw (FIG. 2).

The front face of the rectangular head portion 33A of each jaw 33 is provided with a series of parallel vertically spaced horizontal V-shaped peaks and valleys forming a toothed gripping surface 33E and a central concave portion 33F having a radius of curvature sufficient to accommodate round steel pipe, landscaped timbers, small trees, tree stakes, tent stakes, T-posts, ground rods, etc. The tooth profile and concave portion provides a positive slip-resistant grip for extracting square or round fence posts, small trees, tent stakes, grounding rods, mailbox posts, sign posts, and the like, of various size, even in wet conditions.

Each jaw 33 is installed on the radial flange 32C of the respective drive screw 32 and its parallel spaced slide bars 33B are positioned adjacent to the guide rails 26 of the respective jaw support platform 20 and then the retainer plate 29 is secured thereover such that the slide bars of the jaw are slidably captured between the bottom of the T-shaped portions 29B of the retainer plate and the top surface of the jaw support platform 20 when assembled together.

Thus, it should be understood from the foregoing description, that the jaw members 33 are slidably mounted and retained on the jaw support platforms 20 of the puller head assembly 19 to be moved relative thereto by the respective drive screws 32. A wrench, ratchet, cordless electric drill with a socket, socket impact gun or other suitable means may be used to rotate the drive screws 32 and provide sufficient torque to move the jaws 33 between a retracted position away from the central opening 22 and an extended gripping position firmly engaged on the object to be lifted.

Figure 5:
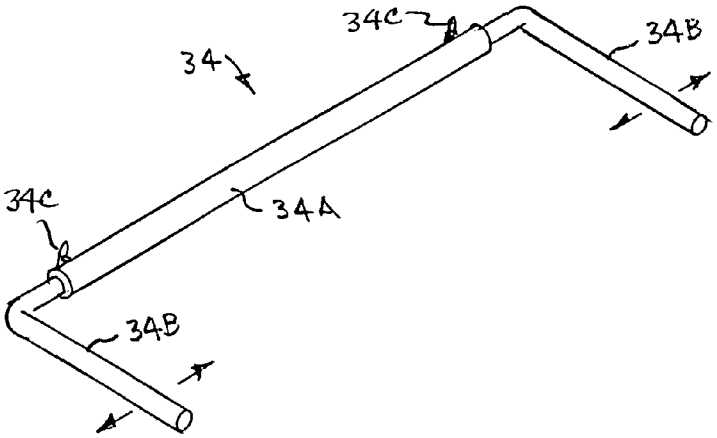
FIG. 5 is a perspective view of a pump handle having laterally adjustable rods at each end for operating both of the hydraulic jack members simultaneously.

Preferably, both jacks 11 are operated simultaneously to raise and remove the object. This may be accomplished by a pump handle 34 having laterally adjustable ends. A suitable pump handle 34 is shown in FIG. 5. The pump handle 34 has an elongate tubular handgrip portion 34A with a pair of L-shaped rods 34B each having one leg slidably received in its opposed ends, and a pair of lock screws 34C near each end for manually locking the rods therein. The L-shaped rods 34B are laterally adjusted such that the ends of their outer facing legs are received in the handle socket 13A of the conventional hydraulic pump rod and cylinder mechanism 13 of the respective jacks 11, and are then locked in the laterally adjusted position by the lock screws 34C. Thus, both jacks may be operated simultaneously by repeatedly raising and lowering the pump handle 34.

Figure 6:
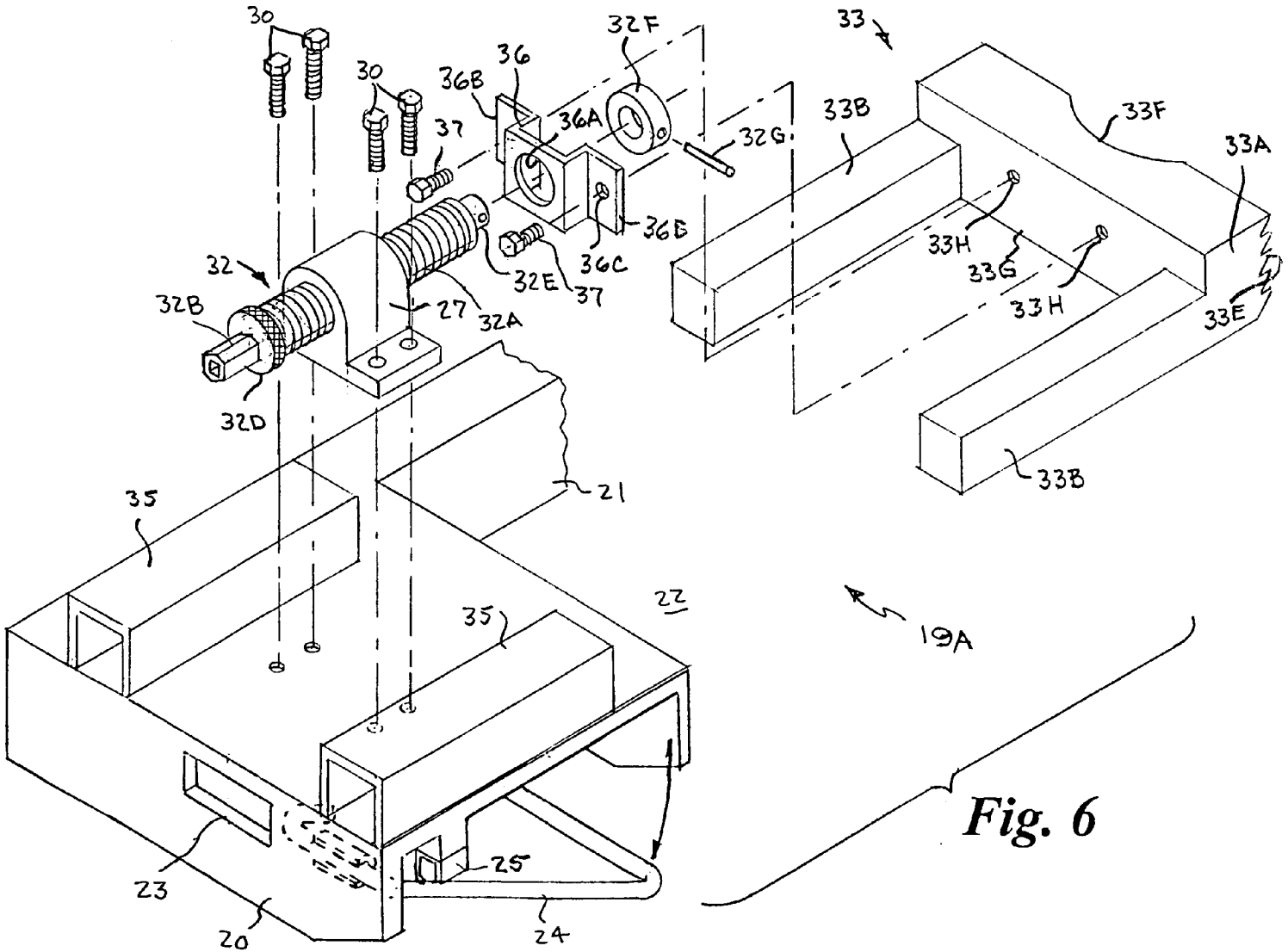
FIG. 6 is an exploded isometric view of one side of an alternate embodiment of the puller head assembly of the hydraulic post puller apparatus.

FIG. 6 shows an exploded isometric view of one side of an alternate embodiment of the puller head assembly 19A. It should be understood that the other side of the puller head 19A is a mirror image of that shown. The components described previously are shown and are assigned the same numerals of reference, but will not be described again in detail here to avoid repetition. In this embodiment each jaw support platform 20 has a pair of parallel spaced hollow rectangular longitudinal guides 35 on its top surface, each extending along a respective longitudinal side, which may be fabricated or integrally formed thereon. A drive block 27 is mounted centrally between the guides 35 on the top surface of each jaw support platform 20 a distance outwardly from the generally U-shaped opening 22, by fasteners 30, and is drilled and tapped to match the threads of the drive screw 32. In this embodiment, the drive screw 32 has a reduced diameter 32E at the inner facing end, onto which a larger diameter collar 32F is pinned with a roll pin 32G, rather than the integrally formed enlarged diameter flange described previously.

A jaw member 33 is slidably mounted on each jaw support portion 20 of the puller head 19A to be moved relative thereto by the respective drive screw 32. The jaw members 33 are essentially the same structure as described previously, having elongate parallel spaced slide bars 33B extending rearwardly from the rectangular head portion 33A, which are slidably received in the guides 35, and having the same toothed and concave gripping surface 33E on their face. In this embodiment, the jaw members 33 do not have an interior recess or U-shaped slot extending upward from its bottom surface. Instead, the back surface 33G of each jaw 33 is provided with a pair of laterally spaced threaded bores 33H and the drive screw 33 is rotatably connected to the jaw by a retractor bracket 36 having a central hole 36A and a pair of laterally opposed wing portions 36B with mounting holes 36C therethrough.

Prior to pinning the larger diameter collar 32F to the reduced diameter end 32E of the drive screw 32, the shank 32A of the drive screw is threadedly engaged in the drive block 27, the central hole 36A of the retractor bracket 36 is inserted onto the shank, and then the larger diameter collar 32F is pinned to the reduced diameter end of the drive screw. The drive block 27 is secured to the jaw support platform 20, and the retractor bracket 36 is secured to the back face 33G of the jaw 33 by threaded fasteners 37 extending through the mounting holes 36C and engaged in the threaded bores 33H of the jaw to capture the larger diameter collar 32F of the drive screw therebetween. Thus, the drive screw 32 is rotatably connected to the jaw 33 to move it relative to the central opening 22 of the puller head 20.

It should be understood that the drive block 27 may also be of a two-piece split-nut construction, as previously described, wherein the drive block would be split in a horizontal plane through centerline of the threaded aperture and the arcuate top half would be attached by machine screws from the top. It should also be understood that the drive block 27 may be integrally formed on the top surface of the jaw support platform.

Figure 7A:
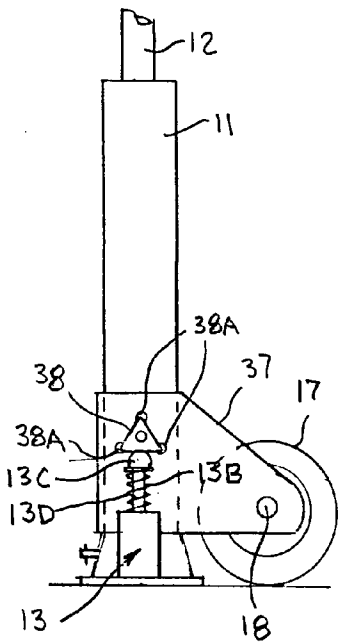
FIG. 7A is a side elevation view of a modification of a jack member having a cam pumping arrangement.
Figure 7B:
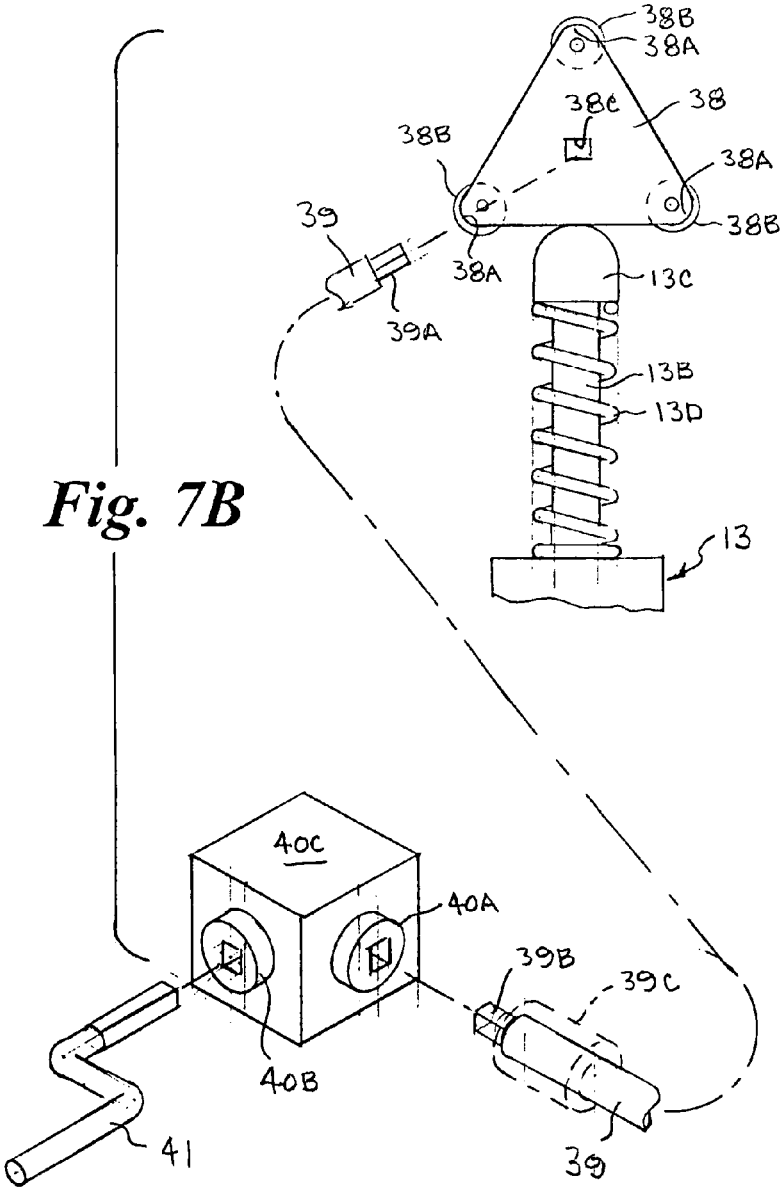
FIG. 7B is a schematic illustration showing a dual cable drive assembly for operating the modified jacks simultaneously.
Figure 7C:
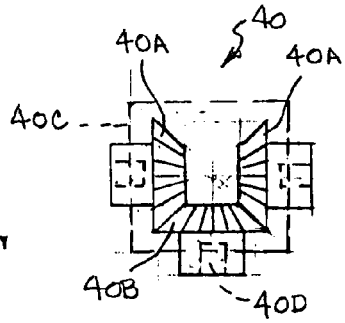
FIG. 7C is a schematic illustration showing the bevel gear assembly of the dual cable drive assembly.

FIGS. 7A, 7B and 7C illustrate, schematically; another modification of the jack members 11 and a dual cable drive assembly for operating the jacks simultaneously. The cam and flexible cable modification enables the jack to be raised at a substantially greater rate than would ordinarily be realized if manually pumping up and down with the conventional pump handle, or the handle having laterally adjustable ends, as described above. In this modification, as seen in FIG. 7A, a bracket 37 is secured to the lower portion of the jack 11 closely adjacent to the pump rod and cylinder assembly 13 and a cam member 38 having three lobes 38A is mounted thereon. A wheel 17, as described previously with reference to FIG. 4, is also shown mounted in the bracket 37.

As illustrated in FIGS. 7B and 7C, the cam member 38 has a bearing 38B rotatably mounted at each of the three lobes 38A and provided with a central square or polygonal drive aperture 38C into which a mating connection 39A at one end of a flexible cable 39 is secured for rotating the cam 38. The pump rod 13B of the pump rod and cylinder assembly 13 is provided with a rounded cap 13C at its top end, and surrounded by a return compression spring 13D engaged at opposed ends between the cylinder housing and the bottom end of the cap to urge it to its extended position.

The other end 39B of the flexible cables 39 are connected to a respective gear 40A of a bevel gear assembly 40, including a drive gear 40B, housed in a gearbox 40C, which may be mounted on the puller head 19 or 19A. The drive gear 40B of the gear assembly is has a square or hexagonal socket 40D exterior of the gearbox, and may be driven by a hand crank 41, wrench, ratchet, cordless electric drill with a hexagonal drive attachment, impact gun or other suitable means to transmit power (torque) via the flexible cable 39 to the cam 38. Preferably, each flexible cable 39 is connected to the gearbox 40C by a conventional quick twist-lock or snap-on type connector 39C, shown schematically in dashed line, so that they will not become disengaged while the jack rams 12 are raised from their lowest to highest positions. Alternatively, the drive gear 40B of the gear assembly may be provided with a square or hexagonal extension exterior of the gearbox and driven by a cordless drill with a square or hexagonal socket or other means to impart rotary motion to the gear assembly and flexible cables.

As the cam 38 rotates, the bearings 38B at the outer ends of the lobes 38A engage the top of the end cap 13C and press it downward and, as they pass thereover, the spring 13D returns the pump rod 13B to its upwardly extended position in a reciprocating movement. It should be understood that the cams may also be provided without the bearings. It should also be understood that the modified pump rods 13B may be manually operated.

OPERATION

Referring again to FIG. 1, the process of pulling a post P or like object where concrete C is encountered should begin with the removal of dirt and grass from the top of the concrete. A visual check for tree roots, phone lines, etc., should be made, and a small probe rod should be inserted into the ground to determine the diameter or width of the concrete slug C, so as to avoid placing one or both hydraulic jacks on top of the concrete.

With the jaws 33 retracted, the puller head 19 is positioned about the object to be lifted with the object P received in the U-shaped opening 22 and the jaw support platforms 20 disposed on opposite sides thereof. The support stands 24 may be swung down to support the puller head 19 a short distance above ground level.

The drive screws 32 are then rotated by a wrench, ratchet, cordless electric drill with a socket, socket impact gun or other suitable means to move the jaws 33 from their retracted position toward U-shaped opening 22 and into engagement with the opposed sides of the object to be lifted and then sufficient torque is applied to firmly engage the toothed gripping surface 33E on the face of the jaws on the object.

The hydraulic jacks 11 with their rams 12 in a lowered position are placed adjacent each end of the jaw support platforms 20 of the puller head 19. Care should be taken to avoid placing the base of either jack on top of the concrete slug. The horizontal tongues 15 at the bottom of the lift arms 14 are engaged in the rectangular opening or slot 23 in the ends of the jaw support platforms 20.

The L-shaped rods 34B of the pump handle 34 are laterally adjusted and their free ends are installed in the handle socket 13A of the hydraulic pump rod and cylinder mechanism 13 of the jacks 11, respectively, and are then locked in the laterally adjusted position by the lock screws 34C. Then both jacks 11 are operated simultaneously by repeatedly raising and lowering the pump handle 34 to raise the puller head 19, and lift the object P gripped thereby, and the concrete slug C in which it is anchored out of the ground.

If the jacks 11 are provided with the optional wheel bracket 16, a wheel 17 may be installed before or after the lifting operation (FIG. 4), and with the jaws 33 still engaged on the object P, the object and its concrete slug C may be easily rolled away by tilting the jacks rearwardly such that the slug is above the ground surface. The wheels 17 also allow the assembled puller apparatus to be easily transported from one object to the next.

By partially digging out one side from a post, even posts with some concrete underneath the edge of a sidewalk or house foundation can be pulled at an angle to clear the obstruction. Because the modified hydraulic jacks are positioned at the ends of the puller head, additional clearance from any concrete slug is gained. Since the puller head is mounted from the side, the posts can be tall or still have nails or boards sticking out above attachment level and cause no problem.

Although a long-ram type hydraulic jack has been shown for purposes of example, it should be understood, that the lift arms and puller head may be supported on various other standard types of hydraulic jacks, such as high-lift or long-ram jacks, farm jacks, bottle jacks, and floor jacks.

It should be understood that the present hydraulic puller apparatus may also be provided with various attachments for use in situations where the posts have broken off near ground level or where a post being removed slips out of its concrete slug leaving the slug in the ground. It should also be understood that the puller head may be adapted to be supported on a backhoe or similar power source by a chain-sling or other accessory. Stabilizer bars may also be connected between the jacks to enhance stability of the puller apparatus.

While this invention has been described fully and completely with special emphasis upon a preferred embodiment, it should be understood that within the scope of the appended claims the invention may be practiced otherwise than as specifically described herein.

What is claimed is:

1. A hydraulic puller apparatus for extracting objects from the ground, including objects that may be anchored in a concrete slug, comprising:

a pair of hydraulic jack members, each having a ground engaging base and an extensible and retractable ram member actuated by a pump rod and cylinder jacking mechanism at said base including actuating means for actuating said pump rod;

a pair of elongate lift arm members each having an upper end pivotally connected to the top of a respective said ram member and an outwardly extending horizontal tongue member at a lower end thereof;

a puller head assembly removably supported at opposed ends on said horizontal tongue member of a respective said lift arm, said puller head having a pair of generally rectangular jaw support platforms disposed in parallel laterally spaced relation defining a central generally U-shaped opening therebetween which is open on one side and sized to straddle the width of the object to be extracted;

a pair of jaw members each slidably mounted on a respective said jaw support platform in opposed facing relation for movement between a retracted position away from said U-shaped opening and an extended gripping position engaged on the object to be extracted, and each having a generally rectangular head portion with an outer facing gripping surface configured to grip opposite sides of the object to be extracted;

a pair of drive screw members, each threadedly engaged on a respective said jaw support platform in opposed facing relation and having an inner facing end engaged with a respective said jaw member for moving said jaw member between said retracted and extended positions upon rotation thereof, and each having an outer facing end configured to receive rotating means for rotating same; wherein said puller head is positioned with said U-shaped opening straddling a lower end of the object to be extracted, said drive screw members are rotated to move said jaws to their extended gripping position firmly engaged on the object to be extracted, said jack members are placed on opposite sides of the object to be extracted, said lift arm tongue members are engaged in opposed ends of said jaw support platforms, and said pump rod and cylinder jacking mechanisms of said jack members are actuated to extend said ram members to a height sufficient to extract the object from the ground.

2. The hydraulic puller apparatus according to claim 1, wherein each of said jaw support platforms has an outer end with a generally rectangular opening therethrough for removably receiving said horizontal tongue member of a respective said lift arm to support said puller head assembly thereon.

3. The hydraulic puller apparatus according to claim 1, wherein each of said elongate lift arms is of a sufficient length to support said puller head assembly on said horizontal tongue member at or just above ground level when said ram member is in a retracted position.

4. The hydraulic puller apparatus according to claim 1, further comprising:

support means at each of said puller head assembly opposed ends for supporting said puller head in a generally horizontal position above the ground surface.

5. The hydraulic puller apparatus according to claim 4, wherein said support means comprises a pair of support stands, each pivotally connected at a first end adjacent to an outer end of a respective said jaw support platform and having second ground engaging end, said support stand capable of being between a generally horizontal stored position and a generally vertical ground engaging support position.

6. The hydraulic puller apparatus according to claim 1, further comprising:

said outer facing gripping surface of each said jaw member generally rectangular head portion comprises a series of parallel vertically spaced horizontal V-shaped peaks and valleys forming a toothed surface, and a central concave portion having a radius of curvature sufficient to accommodate round objects to be extracted, whereby said outer face provides a positive slip-resistant grip for extracting square or round objects to be extracted.

7. The hydraulic puller apparatus according to claim 1, further comprising:

jaw guide means on each said jaw support platform engaged with a respective said jaw member to slidably retain said jaw member on said jaw support platform during movement between its said retracted position and extended gripping position and while engaged on the object to be extracted during the extraction operation.

8. The hydraulic puller apparatus according to claim 1, wherein each said jaw member has a pair of elongate parallel spaced slide bars extending rearwardly from said rectangular head portion which are slidably retained on a respective said jaw support platform.

9. The hydraulic puller apparatus according to claim 8, further comprising:

jaw guide means on each said jaw support platform engaged with said pair of elongate parallel spaced slide bars of a respective said jaw member to slidably retain said jaw member on said jaw support platform during movement between its said retracted position and extended gripping position and while engaged on the object to be extracted during the extraction operation.

10. The hydraulic puller apparatus according to claim 9, wherein said jaw guide means comprises a pair of upstanding longitudinal guide rails on the top surface of each said jaw support platform inwardly adjacent to opposed longitudinal sides thereof, and a retainer plate secured thereover such that said slide bars of said jaw member are slidably captured between said retainer plate and said top surface of said jaw support platform.

11. The hydraulic puller apparatus according to claim 9, wherein said jaw guide means comprises a pair of hollow generally rectangular longitudinal guides on the top surface of each said jaw support platform inwardly adjacent to opposed longitudinal sides thereof, and said slide bars of said jaw member are slidably retained therein.

12. The hydraulic puller apparatus according to claim 1, further comprising:

an upstanding drive block on the top surface of each said jaw support platform disposed a distance outwardly from said U-shaped opening and having a threaded aperture extending therethrough;

each of said drive screw members having a threaded shank portion threadedly engaged in a respective said drive block for moving a respective said jaw member between said retracted and extended positions.

13. The hydraulic puller apparatus according to claim 1, further comprising:

a wheel removably and rotatably mounted on each of said hydraulic jack members adjacent to said base.

14. The hydraulic puller apparatus according to claim 1, further comprising:

actuating means adapted to be releasably engaged with said pump rod and cylinder jacking mechanism of both said hydraulic jack members for actuating both simultaneously;

whereby both said ram members are extended simultaneously to extract the object from the ground.

15. The hydraulic puller apparatus according to claim 14, wherein each said pump rod and cylinder jacking mechanism includes a socket member pivotally mounted at one end on said hydraulic jack member and engaged with said pump rod for moving said pump rod in a reciprocating pumping action; and said actuating means comprises a pump handle releasably engaged with said socket of said rod and cylinder jacking mechanisms of both of said hydraulic jack members for actuating both simultaneously;

whereby both said ram members are extended simultaneously to extract the object from the ground.

16. The hydraulic puller apparatus according to claim 15, wherein said pump handle having opposed laterally adjustable spaced ends each adapted to be received in respective said pump rod and cylinder jacking mechanism socket.

17. The hydraulic puller apparatus according to claim 14, further comprising:

a cam member rotatably mounted on each said hydraulic jack member and having an outer periphery configured to intermittently engage said pump rod of said pump rod and cylinder jacking mechanism and move said pump rod in a reciprocating pumping action upon rotation of said cam member; and said actuating means is connected with said cam member of both of said hydraulic jack members for rotating both cam members simultaneously;

whereby both said ram members are extended simultaneously to extract the object from the ground.

18. The hydraulic puller apparatus according to claim 17, wherein said actuating means comprises rotary drive means for rotating both cam members simultaneously.

19. The hydraulic puller apparatus according to claim 18, wherein said rotary drive means comprises:

a gear assembly including a drive gear operatively engaged with a pair of driven gears;

a pair of flexible cables each having a first end connected with a respective said driven gear and a second end connected with a respective said cam member, said drive gear adapted to releasably receive rotating means for rotating said drive gear and driven gears and transmitting torque through said flexible cables to said cam members to impart rotary motion thereto.

20. A method for extracting objects from the ground, including objects that may be anchored in a concrete slug, comprising the steps of:

providing a pair of hydraulic jack members, each having a ground engaging base and an extensible and retractable ram member actuated by a pump rod and cylinder jacking mechanism at said base including actuating means for actuating said pump rod, and an elongate lift arm pivotally connected at an upper end to the top of said ram member and having an outwardly extending horizontal tongue member at a lower end thereof;

providing a puller head having a pair of jaw support platforms disposed in parallel laterally spaced relation defining a central generally U-shaped opening therebetween which is open on one side and sized to straddle the width of the object to be extracted, a pair of jaw members each slidably mounted on a respective jaw support platform in opposed facing relation and having a head portion with a gripping surface, and a drive screw threadedly engaged on a respective jaw support platform having an inner facing end engaged with a respective jaw member for moving said jaw member between a retracted and extended position upon rotation thereof, each drive screw having an outer facing end for receiving rotating means for rotating same;

positioning said puller head with its said U-shaped opening straddling a lower end of the object to be extracted, and rotating the drive screws to move the jaws to their extended gripping position firmly engaged on opposite sides of the object to be extracted;

placing said jack members on opposite sides of the object to be extracted, and engaging the lift arm tongue members in opposed ends of the jaw support platforms; and actuating said pump rod and cylinder jacking mechanisms of said jack members to extend said ram members to a height sufficient to extract the object from the ground.

* * * * *